US007194937B1

(12) United States Patent
Melkowits

(10) Patent No.: US 7,194,937 B1
(45) Date of Patent: Mar. 27, 2007

(54) KNOCKOUT REMOVING PLIERS AND METHOD OF USING SAME

(76) Inventor: Robert Melkowits, 5 Pamela Rd., East Brunswick, NJ (US) 08816

( * ) Notice: Subject to any disclaimer, the term of this patent is extended or adjusted under 35 U.S.C. 154(b) by 0 days.

(21) Appl. No.: 11/265,844

(22) Filed: Nov. 3, 2005

(51) Int. Cl.
*B25B 7/02* (2006.01)
*B25B 7/10* (2006.01)

(52) U.S. Cl. ..... 81/426; 81/418

(58) Field of Classification Search ..... 81/426, 81/418, 424.5; 29/268
See application file for complete search history.

(56) References Cited

U.S. PATENT DOCUMENTS 2,948,171 A * 8/1960 Lucibello ..... 72/409.01
4,075,749 A * 2/1978 Hubeny ..... 29/268
4,149,435 A * 4/1979 Smith ..... 81/426
5,058,414 A * 10/1991 Hayes ..... 72/379.2
6,216,568 B1 * 4/2001 Breiling ..... 81/426

FOREIGN PATENT DOCUMENTS

JP 05228851 A * 9/1993

* cited by examiner

*Primary Examiner*—David B. Thomas
(74) *Attorney, Agent, or Firm*—Ward & Olivo

(57) ABSTRACT

Disclosed is an electrical tool for removing knockouts from electrical boxes. The tool includes a first arm and a second arm each comprising a handle, a jaw, and a recess joining the handle and the jaw. A pivot pin rotatably joins the first and second arms while an elongated slot allows the second arm to slide along the slot relative to the first arm. The first jaw includes two projections to be placed on one side of an electrical box wall. The second jaw includes a projection which is placed within the circumference of a knockout. Serrated projections which extend from the end of the first and second handles can grip the knockout and remove the knockout from the electrical box wall.

4 Claims, 6 Drawing Sheets

FIG. 3
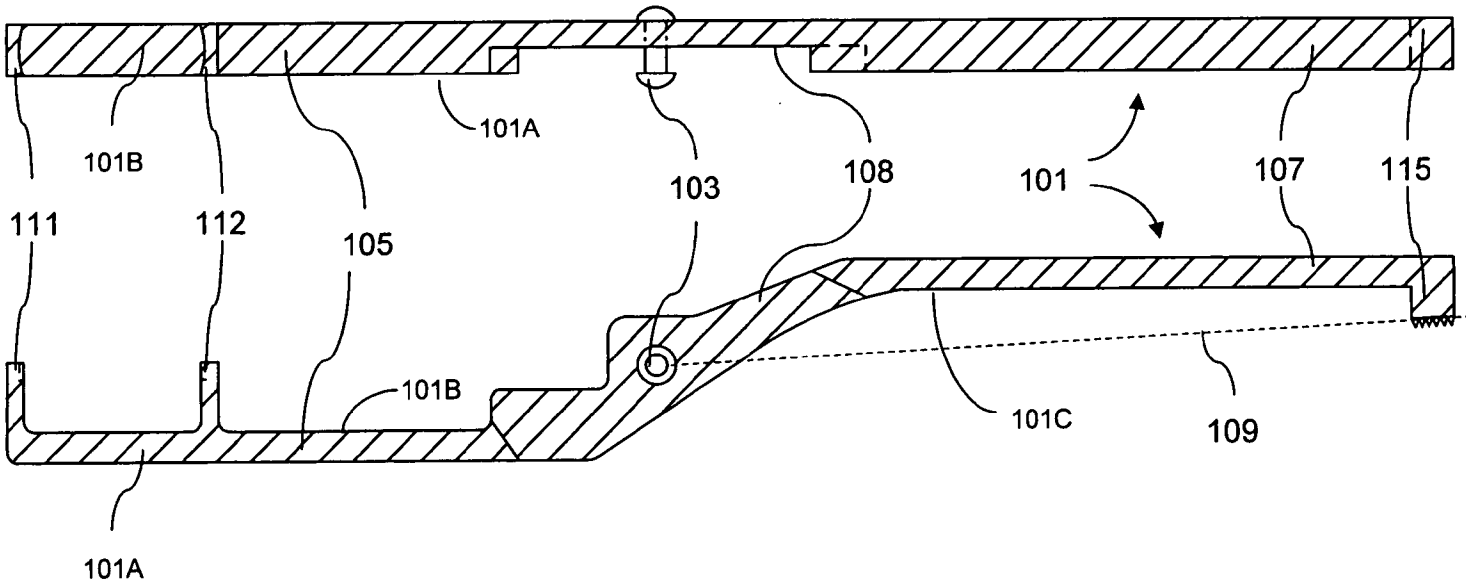
FIG. 2
FIG. 4
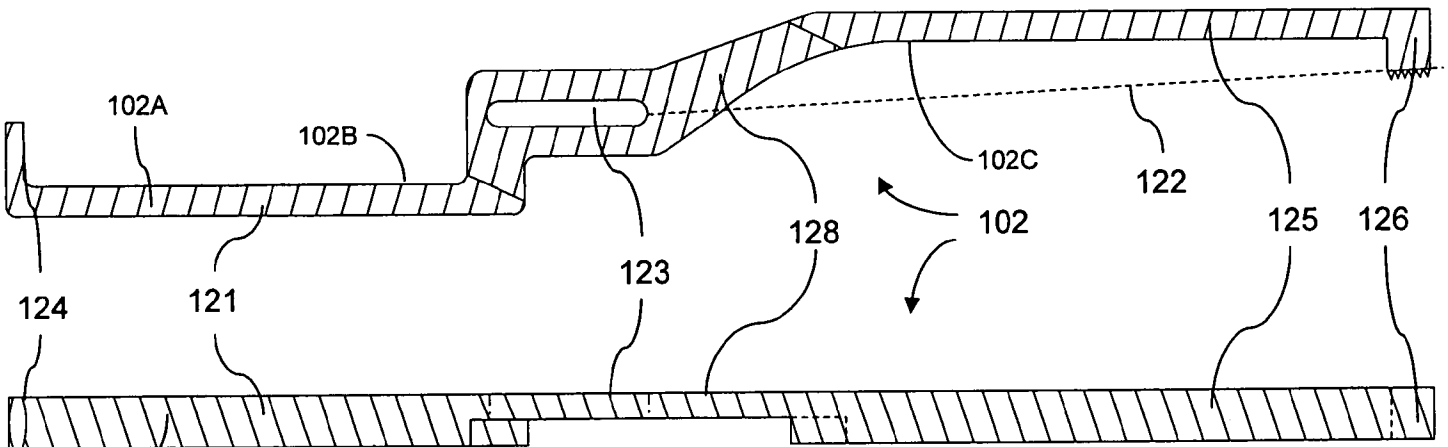
FIG. 5
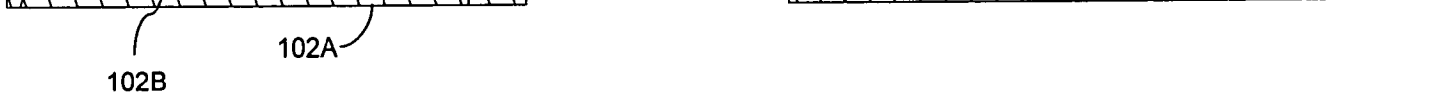

KNOCKOUT REMOVING PLIERS AND METHOD OF USING SAME

FIELD OF THE INVENTION

The present invention relates to a tool and a method for removing knockouts from electrical boxes. In particular, the present invention relates to a tool capable of removing knockouts from an electrical box which has already been recessed to a wall or otherwise connected to a separate surface.

BACKGROUND OF THE INVENTION

Since the earliest days of man, tools have been used to increase productivity. From crude rocks which functioned as a hammer to modern day power tools, these devices aid man in a variety of ways. For example, a hammer helps provide additional force and torque, allowing a user to more efficiently fasten items together. Over the course of time, a variety of other tools have been developed to assist and speed up a user's work.

Accordingly, tools have been developed to aid in the installation of electrical wires. Traditionally, electrically conductive wires are routed to various receptacles which are attached to a dwelling by a small electrical box. To prevent fires due to an unexpected electrical overload, the wires are routed to circuit breakers which are located in a larger, centralized electrical box. To speed up the routing of the electrical wires, these electrical boxes contain removable sections known as "knockouts." Knockouts are perforated circular pieces in electrical boxes which when removed permit insertion of wire. They are attached to the electrical box by a single tab.

To remove knockouts, workers conventionally use a hammer, a screwdriver, and pliers. The screwdriver head is placed on the knockout. A user hits the screwdriver handle with a hammer causing the perforated portion of the knockout to split from the electrical box. However, after the knockout is split, it is still attached to the electrical box by the tab. To fully remove the knockout, a pair of pliers is used to bend and twist the knockout. This loosens the knockout and eventually snaps the tab. As a result, the conventional method requires a number of tools and is time consuming as well as dangerous.

Attempts have been made to create a single tool for removing knockouts. For example, a punch-like, tool is known which has an interlocking hollow ring and cylinder. The ring portion is placed on the electrical box wall surrounding the knockout and a cylinder, which acts as a punch, is placed on the knockout. A force exerted on the tool causes the knockout to split from the electrical box. However, the tool is inefficient in that a pair of pliers is further required to snap and remove the split knockout from the tab.

Another known tool provides two jaws capable of splitting and gripping the knockout. The jaws have opposing projections. To use the tool, one projection is placed on the electrical box wall while the other is placed on the knockout. Providing force on the tool handle splits the knockout. To remove the knockout, the opposing end of the tool has an opposing end comprising ribbed ends. However, the design of the jaw prohibits the knockout from efficiently separating from the electrical box. Thus, a separate prying means is necessary to separate the knockout. Additionally, the tool is unstable because it exerts a counter rotational force on the user. As a result, the tool can easily slide out of place Thus, what is needed is a single, well designed tool for easily and efficiently removing knockouts from electrical boxes.

SUMMARY OF THE INVENTION

One object of the present invention is to provide a tool and a method for removing knockouts from electrical boxes.

Another object of the present invention is to provide a slim sized tool capable of removing knockouts from electrical boxes which have already been installed.

Another object of the present invention is to provide an adjustable tool capable of splitting different sized knockouts.

Another object of the present invention is to provide a tool having serrated projections to grip the knockout after the knockout has been split to remove the knockout from the electrical box wall.

To accomplish these and other objects, the present invention comprises a tool for removing a knockout from an electrical box having at least one side wall and a back wall including a first arm and a second arm. The first and second arms each comprise a handle, a jaw, and a recess which connects the handle to the jaw. The first jaw includes two projections extending toward the second jaw and is spaced apart to span the diameter of a knockout. The second jaw includes one projection which extends toward the first jaw and is positioned between the projections of the second jaw.

A pivot pin is mounted to the recess of the first arm. The second arm recess includes an elongated slot for slidably receiving the pivot pin such that the pivot pin rotatably joins the first and second arms, and has a length such that the second arm slides along the slot relative to the first arm. Importantly, this allows the projection located on the second jaw to remain between the projections located on the first jaw.

In use, the tool is positioned such that the jaw with multiple projections is placed outside the circumference of a knockout. The projection of the other jaw is placed within the circumference of the knockout. A force is provided on the first and second handle causing the knockout to be split from the electrical box wall. Additionally, the first and second handles comprise serrated projections resembling the end of a pair of pliers which extends from the end of the first and second handles so that a user can grip the knockout after the knockout has been split to remove the knockout from the electrical box wall. Additionally, for ease of use and comfort, the handles can have a grip enhancing material.

In addition, the present invention discloses a method for removing a knockout from an electrical box having at least one side wall and a back wall. The method includes placing two first projections outside the circumference of the knockout on one side of the wall and placing a second projection within the circumference of the knockout on opposing side of the wall, providing an opposing force on the first projections and the second projection, causing the knockout to be split from the wall, and removing the knockout by a pair or pliers.

BRIEF DESCRIPTION OF THE DRAWINGS

A further understanding of the present invention can be obtained by reference to a preferred embodiment set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

FIG. 2 illustrates an inside face view of the first arm in accordance with the present invention.

FIG. 3 illustrates an inside top view of the first arm in accordance with the present invention.

FIG. 4 illustrates an inside face view of the second arm in accordance with the present invention.

FIG. 5 illustrates an inside top view of the second arm in accordance with the present invention.

DETAILED DESCRIPTION OF THE INVENTION

Detailed illustrative embodiments of the present invention are disclosed herein. However, techniques, systems and operating structures in accordance with the present invention may be embodied in a wide variety of forms and modes, some of which may be quite different from those in the disclosed embodiments. Consequently, the specific structural and functional details disclosed herein are merely representative, yet in that regard, they are deemed to afford the best embodiments for purposes of disclosure and to provide a basis for the claims herein which define the scope of the present invention. The following presents a detailed description of preferred embodiment of the present invention.

Figure 1:
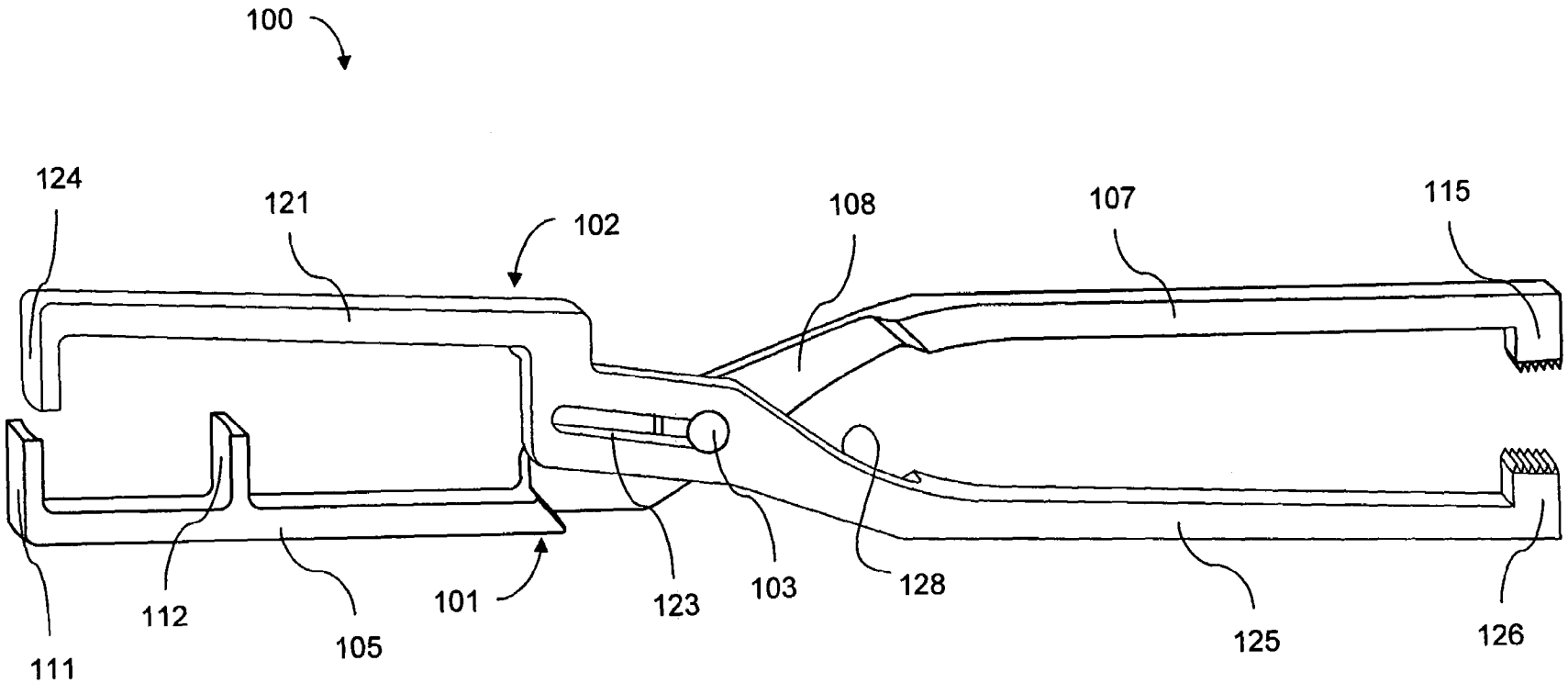
FIG. 1 illustrates a perspective view of the tool in accordance with the present invention.

FIGS. 1–5 illustrate the preferred embodiment of an electrician's tool 100 in accordance with the present invention. In particular, FIG. 1 illustrates a perspective view of the tool 100, FIGS. 2–3 illustrate inside face and top views of first arm 101, and FIGS. 4–5 illustrate inside face and top views of second arm 102. The tool 100 generally comprises arms 101 and 102 rotatably attached by pivot pin 103. Of course, it will be appreciated by those of ordinary skill in the art that arms 101 and 102 can be attached by any other well known means without departing form the spirit of the invention.

Specifically, first arm 101 includes first jaw 105, first handle 107, and first recess 108. In a preferred embodiment, pivot pin 103 is mounted substantially at the center of the first recess 108. However, pivot pin 103 can be mounted at ant portion of first recess 108. First recess 108 is disposed on inside face 101A of first arm 101 between first jaw 105 and first handle 107. Further, first recess section 108 is projected at an angle from top face 101B of first jaw 105, at one end. Preferably, the angle is obtuse. On the other end, first recess section 108 is projected at an angle from bottom face 101C of first handle 107. In a preferred embodiment, the angle is obtuse. As a result, first jaw 105 and first handle 107 are substantially parallel and are offset by recess section 108.

Figure 6B:
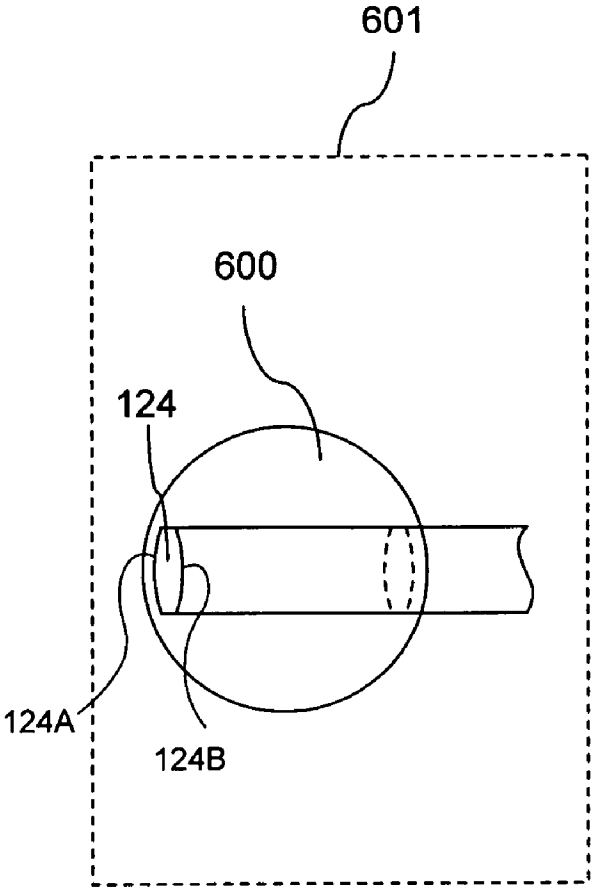
FIGS. 6A–6B illustrates a plan view of the first and second arm projections aligned with the knockout in accordance with the present invention.
Figure 6A:
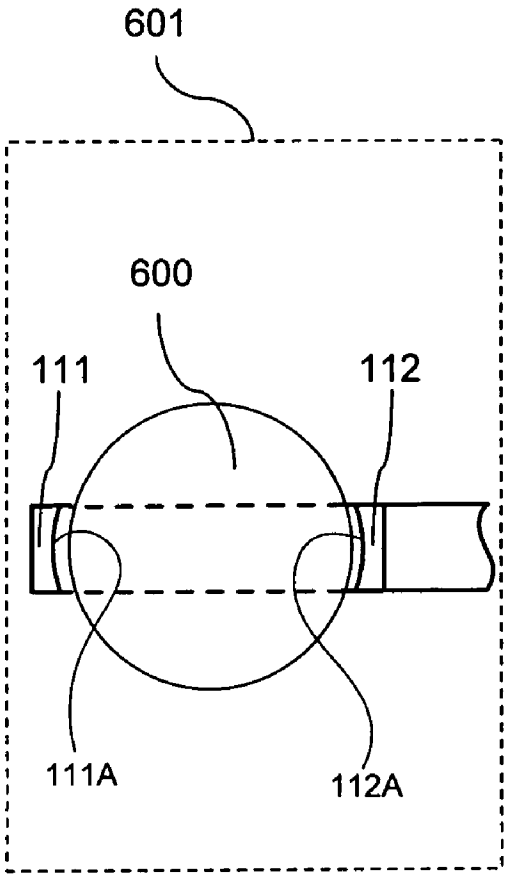

Two projections 111 and 112 extend from top face 101B of first jaw 105. Projection 111 extends from the end of first jaw 105, while projection 112 extends between the end of first jaw 105 and first recess 108. As illustrated in FIG. 6A, projections 111 and 112 have semi-circular concave cutouts, 111A and 112A respectfully, disposed on the inner opposing walls. It is contemplated, however, that projections 111A and 112A can take any shape. Preferably, projections 111 and 112 extend at least one inch from first jaw 105 to allow a user to easily insert tool 100 between a surface wall (not pictured) and an electrical box wall 601. As such, projections 111 and 112 can be placed on electrical box wall 601 without blocking knockout 600.

Similarly, second arm 102 includes second jaw 121, second handle 125, and second recess 128. Second recess 128 is disposed on inside face 102A of second arm 102 between second jaw 121 and second handle 125. Second recess section 128 is projected at an angle from top face 102B of second jaw 121 on one end and from bottom face 102C of the second handle 125 at the other end. Preferably, this angle is obtuse. Consequently, second jaw 121 and second handle 125 are substantially parallel and are offset by recess section 128.

Second recess section 128 includes elongated slot 123 cut through inner face 102A. Elongated slot 123 slidably receives pivot, pin 103 attached to first arm 101. As such, pivot pin 103 rotatably joins first and second arms 101 and 102.

Projection 124 extends from top face 102B of second jaw 121 end. In a preferred embodiment second jaw 121 is shorter in length than first jaw 105 to position projection 124 between projections 111 and 112 when the tool 100 is in a "closed" position. In a preferred embodiment, projection 124 extends at least 1 inch. As illustrated in FIG. 6B, projection 124 has semi-circular convex like cutouts 124A and 124B disposed on its inner and outer walls. It is contemplated that any shaped cutouts can be used in accordance with the present invention. As such, projection 124 can be placed inside the inner perimeter of knockout 600 without touching electrical box wall 601.

Figure 9:
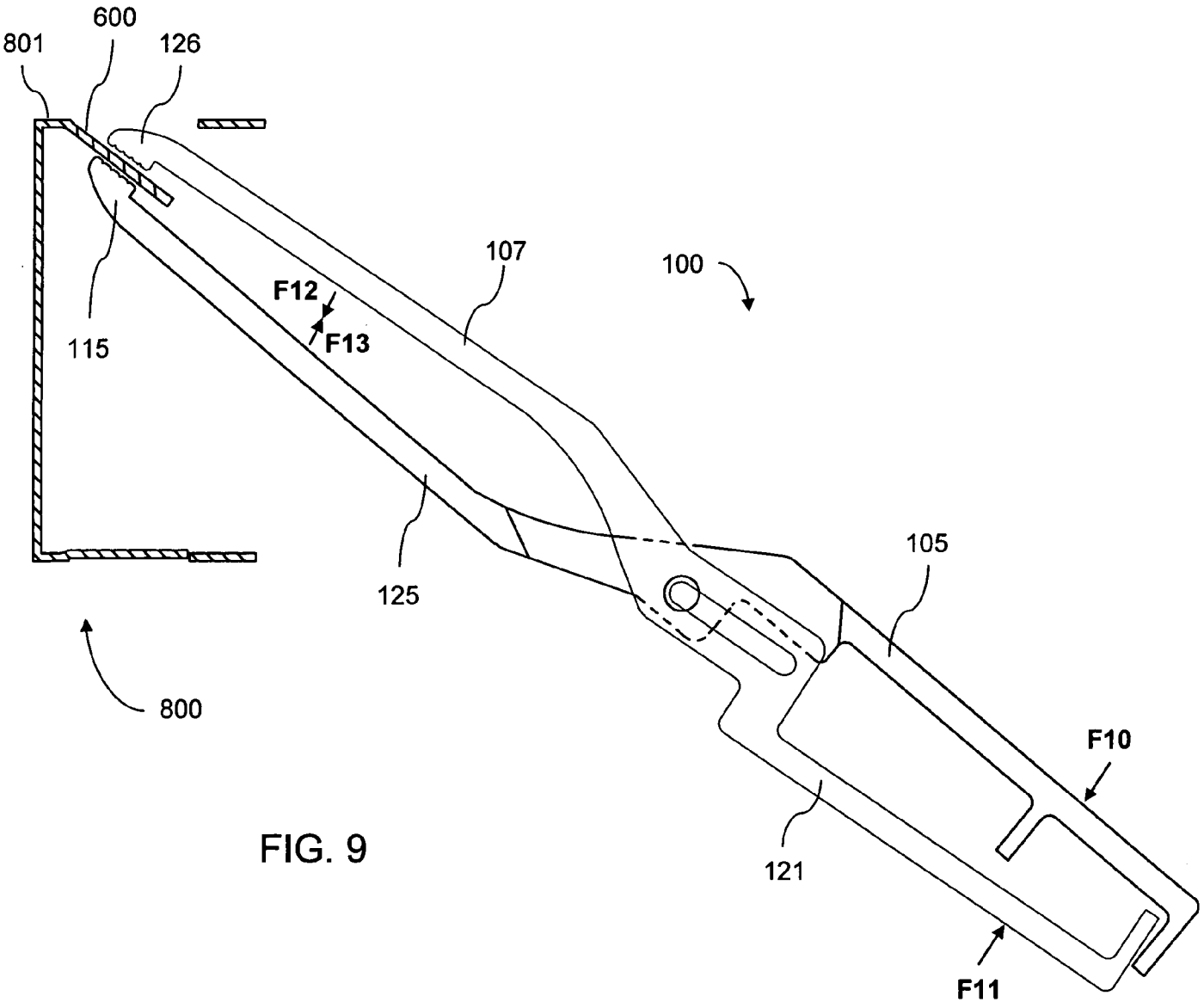
FIG. 9 illustrates a plan view of the tool gripping a knockout to completely remove the knockout from the electrical box wall in accordance with the present invention.

First and second handles 107 and 125 preferably include serrated projections 115 and 126 respectfully. Serrated projections 115 and 126 can be used as pliers to grip and remove the split knockout from an electrical box. To better grip the knockout, serrated projections 115 and 126 need to be aligned when tool 100 is in the "closed" position. Preferably, serrated projections 115 and 126 are slanted along lines 109 and 122 to align projections 115 and 126. The angle is determined by an angle of rotation between the closed position of tool 100 and a position where first and second handles 107 and 125 are substantially parallel. As depicted in FIG. 9 serrated projections 115 and 126 rest parallel to knockout 600 when tool 100 is in closed position.

For comfort and utility purposes handles 115 and 126 or any other portion of tool 100 may be covered with gripping material. Preferred examples include rubber, plastic, or other composite materials well known in the art. In addition, the material can be molded to a human hand shape to achieve an even more comfortable and secure grip. Alternatively, the material can have a rough surface to prevent tool 100 from slipping.

Figure 7:
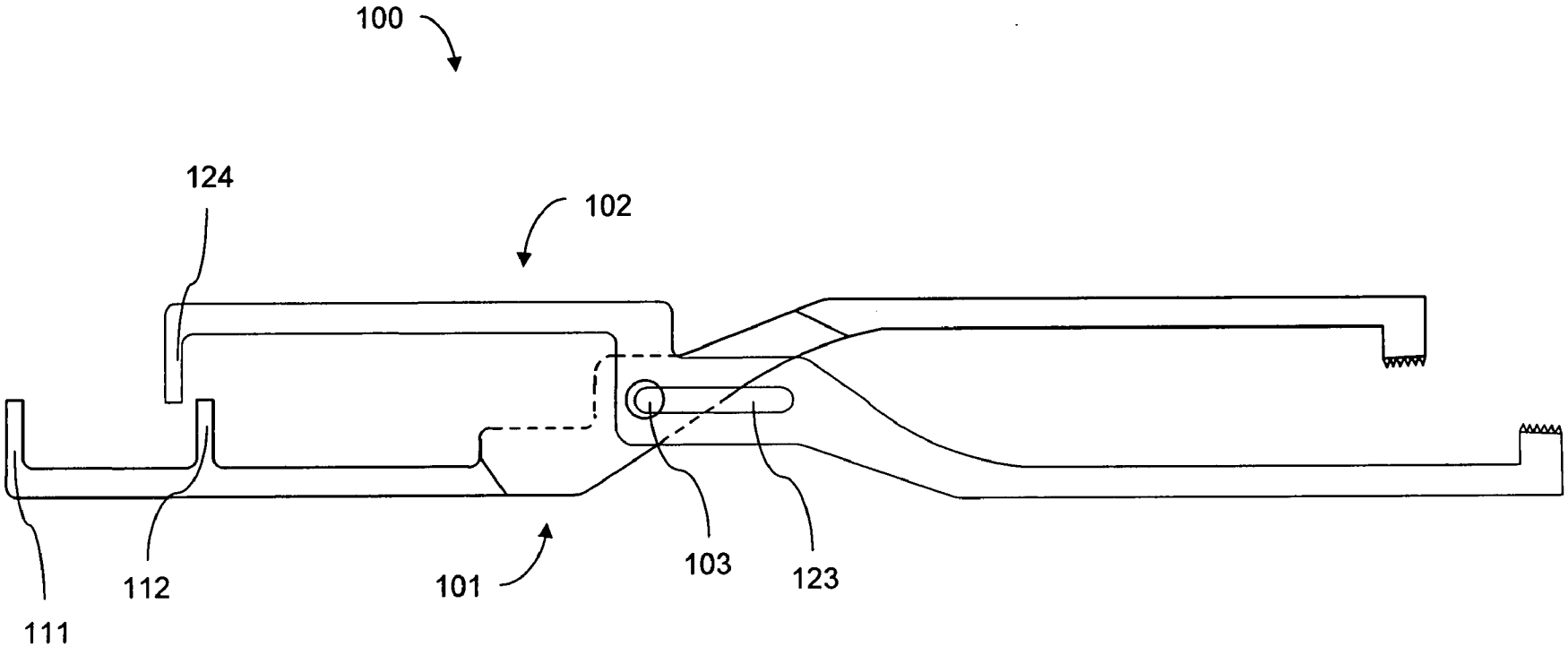
FIG. 7 illustrates a plan view of the tool in an extended position in accordance with the present invention.

FIG. 7 illustrates tool 100 in an extended position. Pivot pin 103 is attached to first arm 101 and is received by slot 123 of second arm 102. As such, second arm 102 slides along slot 123 relative to first arm 101. It is preferred by the present invention that slot 123 has a length which restricts the second arm's slidable movement so 124 projection remains between projections 111 and 112. Advantageously, the slidable movement of second arm 102 allows tool 100 to accommodate a variety of conduit sizes. For example, the slidable movement can accommodate ½, ¾, land other standard sizes. Projections 111 and 112 can be placed on the electrical box wall, outside the circumference of the knockout, while projection 124 can be adjusted by sliding second arm 102 and placed on the inner circumference of the knockout. In a preferred embodiment, the spacing between projections 111 and 112 should be large enough to accommodate many knockouts sizes available in the market.

Figure 8:
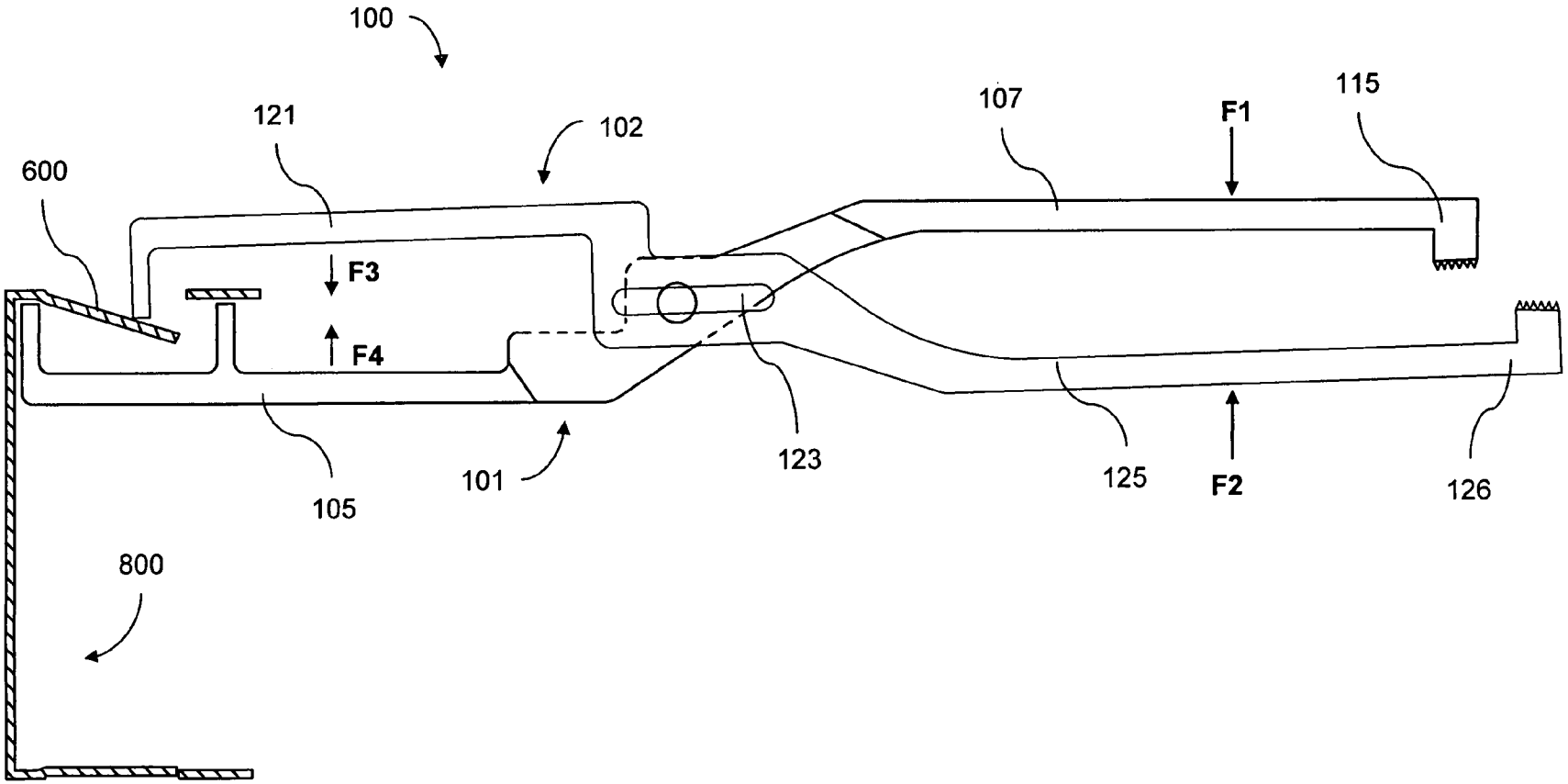
FIG. 8 illustrates a plan view of the tool engaging an electrical box wall and a knockout to split the knockout from the electrical box wall in accordance with the present invention.

In application, as illustrated in FIG. 8, first arm 101 is placed on the wall inside electrical box 800 and second arm 102 is placed on the opposing wall outside electrical box 800. In more detail, projections 111 and 112 are placed on electrical box wall 601, outside the circumference of knockout 600, as illustrated in FIG. 6A. The second arm 102 is slid along slot 123 and adjusted to be positioned within the circumference of knockout 600, as illustrated in FIG. 6B.

As depicted in FIG. 8, when the tool is properly positioned in place, opposing forces F1 and F2 are applied inwardly on the first and second handles 107 and 125. Force F1 causes the first jaw 105 to exert force F4 on the inside wall of electrical box 800. Force F2 causes the jaws 105 and 121 move toward each other knockout 600 is split from electrical box 800.

A conventional electrical box has knockouts which have connection tabs securing the knockout to the electrical box. As a result, when knockout 600 is split from electrical box 800 it remains attached to the electrical box 800 via the connection tab 801 as illustrated in FIG. 9. To remove the knockout, serrated projections 115 and 126 are placed on opposing sides of the split knockout 600. By exerting inwardly opposing forces F10 and F11 on first and second jaws 105 and 121, the serrated projections 115 and 126 are drawn toward each other by forces F13 and F12, respectfully, and grip knockout 600. Bending and twisting knockout 800 using the tool 100 loosens and snaps connection tab 801 thereby removing the knockout 600 from the electrical box 800.

It is preferred that tool 100 be made of a light weight and sturdy material which is capable of supporting a large amount of force. Preferably, the tool is comprised of steel. Even more preferably, it is comprised of drop forged steel. However, other well known materials can be used without departing from the spirit of the present invention. Additionally, a slim tool design is preferred to remove knockouts from already installed electrical boxes. When tool 100 has a slim cross section, arm 121 can be easily slid between an electrical box and a conventional wall (not shown) to which it is mounted split the knockout.

While the preferred embodiment of the present invention has been disclosed in detail with reference to a single example, it should be understood by those of ordinary skill in the art that the present invention is not limited by this embodiment. Rather, other well known variations, apparent to those of skill in the art, can be utilized in conjunction with the present disclosed embodiment without departing from the spirit of the invention. As a result, the present invention should not be limited to the preferred embodiment described below but should be construed according to the claims below.

What is claimed is:

1. A tool for removing a knockout from an electrical box having at least one side wall and a back wall comprising:

a first arm having a first handle, a first jaw, and a first recess joining said first handle and said first jaw;

a second arm having a second handle, a second jaw, and a second recess joining said second handle and said second jaw; and a pivot pin mounted to said first recess;

wherein said first jaw includes two first projections extending toward said second jaw and being spaced apart to span the diameter of said knockout;

wherein said second jaw includes one second projection extending toward said first jaw and positioned between said first projections; and wherein said second recess includes an elongated slot for slidably receiving said pivot pin such that said pivot pin rotatably joins said first and second arms, and having a length such that said second arm slides along said slot relative to said first arm while said second projection remains between said first projections.

2. A tool according to claim 1 wherein said first and second handles further comprise serrated projections extending from an end of each of said first and second handles.

3. A tool according to claim 1 wherein said first and second handles further comprise grip enhancing material.

4. A tool according to claim 1 wherein said tool splits said knockout from an already installed electrical box.

* * * * *